United States Patent [19]

DiForti et al.

[11] 4,045,832

[45] Sept. 6, 1977

[54] FITTED SHEET CONSTRUCTION

[76] Inventors: Paula Anne DiForti; Thomas DiForti, both of 20892 Queens Park Lane, Huntington Beach, Calif. 92646

[21] Appl. No.: 686,444

[22] Filed: May 13, 1976

Related U.S. Application Data

[63] Continuation-in-part of Ser. No. 522,376, Nov. 8, 1974, abandoned.

[51] Int. Cl.[2] ..... A47G 9/00

[52] U.S. Cl. ..... 5/334 C; 5/354

[58] Field of Search ..... 5/334 R, 334 C, 335, 5/354 R

[56] References Cited

U.S. PATENT DOCUMENTS

| | | | |
|---|---|---|---|
| 2,195,039 | 3/1940 | Shauer | 5/334 C |
| 2,727,253 | 12/1955 | Tomsic | 5/334 C |
| 2,804,632 | 9/1957 | Ford | 5/334 C |
| 2,972,756 | 2/1961 | Monier et al. | 5/334 C |
| 3,066,321 | 12/1962 | Kintner | 5/334 C |
| 3,243,827 | 4/1966 | Kintner | 5/334 C |

*Primary Examiner*—Casmir A. Nunberg

[57] ABSTRACT

A fitted, adjustable bed sheet is provided which is adapted for use with either spring or water bed mattresses. A substantially rectangular fabric has a top sleeping panel, four depending side panels with substantially square apertures cut between adjacent perpendicular edges of said side panels, and four fitted corners. Each corner is partially stitched beginning at the top of the open portion of the corner formed by the aperture and extending inwardly towards the top panel to form a dart. When the sheet is positioned on the mattress, the stitched portion of each sheet corner while the lower portion of top portion of the mattress corner while the lower portion of each mattress corner protrudes through the aperture formed between adjacent sheet side panels. The sheet is maintained in position on the mattress by a flap secured to the lower edge of a first side panel adjacent each corner. This flap extends outwardly towards the adjacent second side panel when the flap is folded under the mattress so that the free end of each flap is adapted to overlie a portion of the adjacent second side panel. Adherend strips mouned on opposed faces of the overlying portions of each flap and second side panel removably and adjustably secure the free end of each flap to the respective second side panel. Means are also provided to secure one edge of an overlying top sheet to any side panel of the fitted sheet.

11 Claims, 11 Drawing Figures

FITTED SHEET CONSTRUCTION

CROSS-REFERENCE TO RELATED APPLICATIONS

This application is a continuation-in-part of application Ser. No. 522,376, filed Nov. 8, 1974, entitled "Fitted Sheet Construction."now abandoned.

BACKGROUND OF THE INVENTION

This invention relates to fitted sheets, and specifically to adjustable fitted sheets which are maintained in position primarily by portions of the sheet bearing against the sides and bottom of the mattress rather than against the corners of the mattress.

While this invention will be described primarily in connection with mattresses, and specifically spring and water bed mattresses, it will be understood that the sheet of this invention may be employed with various other types of cushions, such as pillows, sofa cushions and the like.

The normal unfitted or flat bed sheet, when used as the bottom sheet to cover a spring bed mattress, has many advantages in that it is adaptable to various size mattresses, may be positioned on the mattress in any of four directions, and may be installed on the mattress one side at a time without the necessity of lifting any portion of the mattress since the sheet edges may be merely folded or tucked in between the mattress and the springs. This later advantage is especially useful in hospitals where it is undesirable to discomfort the patient by lifting the corners and edges of the mattress, such as is necessary with the common contoured sheet. Flat bed sheets, however, are easily pulled out of position during the normal tossing and turning of a person sleeping on a bed. Such sheets consequently become wrinkled after a short period of time creating discomfort and, in hospital situations, causing bed sores.

The contoured bed sheets seek to overcome some of the problems of the flat sheet by elastic sewn around the top and bottom of the sheet and extending around all four corners. In order to install a contoured bed sheet on a spring mattress, three corners of the sheet are normally fitted around the first three mattress corners and the fourth corner of the mattress is then lifted to a substantial height in order to place the fourth corner of the sheet around the fourth mattress corner. Upon allowing the mattress to resume its original position, the contoured sheet is stretched tight across the top of the mattress and also at the corners, thus maintaining the sheet in a stretched or taut position for the normal period of time between washings. The contoured sheet has various disadvantages, however, since the tension created by the dimensions of the sheet and the elastic accelerates sheet wear to such an extent that the corners of the sheet frequently rip and the elastic wears out and shrinks before the normal life of the sheet fabric. In addition, the necessity for lifting at least one corner of the mattress to a considerable height when installing the sheet makes the contoured sheet particularly unsatisfactory for use in hospitals and the like. Furthermore, tension created across the top of the mattress by a contoured sheet diminishes the full capacity of the mattress. For example, some mattresses are constructed with an abundance of coil springs in order to allow the mattress to conform to the body contour of the person sleeping on the mattress. If a contoured sheet is installed on such a mattress, the mattress will be placed under tension which tends to curl the corners and edges of the mattress upwardly and inwardly and to create stresses in the mattress which its designers did not intend. Such a prestressed mattress will not operate as intended and will thus deprive its owners of some of the benefits for which it was purchased. Such contoured sheets are also extremely awkward to fold and store due to the permanently crimped corners and the action of the elastic.

Water bed mattresses have presented a particular problem to the bedding industry. These mattresses are a generally rectangular rubber or plastic container with a substantially rounded nose around the sides and at the corners instead of square sides and corners. When such a mattress is filled with water, it generally raises to a height of about ten inches. A normal fitted sheet is extremely unsatisfactory as the bottom sheet on a water bed mattress since it will be pulled loose from underneath the mattress in an extremely short period of time by displaced water pushing outwardly towards the mattress corners when a person sits or lies on the water bed. This displaced water hits against the corners of the mattress while at the same time the top surface of the mattress is placed under tension which tends to raise the corners of the mattress. Concurrently, the overlying sheet is placed under tension by the person sitting or lying on the bed. These stresses combined with the raised mattress corners eventually result in either tearing the corners or quickly loosening the sheet or both.

In an attempt to solve this problem, regular contoured sheets have been modified to provide deeper corners or pockets to accommodate water bed mattresses which are approximately ten inches high, whereas regular spring mattresses are only about seven inches high. These contoured sheets have not solved the problem, however, since if they do remain in place on the mattress corners, the pressure against the sheet corners by the displaced water action described above causes the sheet corners to tear after a very short period of time. In any event, the sheet corners usually come loose from the mattress corners and thus these sheets continue to possess both disadvantages, that is, the sheet corners are subjected to stress until the sheet corners tear or come loose or both.

The top sheet commonly sold with contoured water bed bottom sheets is sewn to the foot of the contoured sheet, thus forming an expensive combination which must be washed, folded and stored together. In addition, since the bottom contoured sheet usually wears out extremely quickly, and certainly before the normal life of the sheet fabric, both the top and bottom sheet are rendered inoperative at an early stage.

The present invention overcomes the disadvantages of the prior art flat and contoured sheets by providing a fitted bottom sheet which has adjustable corners securely retained over the mattress corners while at the same time eliminating stress against the sheet corners and across the top sleeping panel of the sheet which might detract from the operability of the mattress. In its application to water beds, the bottom fitted sheet of this invention provides an aperture at each corner through which a portion of the water bed corners protrude so that the stresses transmitted to the water bed mattress corners by activity upon the mattress is not transferred to the sheet corners. Furthermore, the corners of this sheet are adjustable to accommodate various mattress dimensions while at the same time the sheets may be folded relatively flat for easy packaging and storage. In addition, these sheets are easily installed by merely folding portions of the sheet underneath the mattress without the necessity of raising the mattress to a substantial height, thus rendering this sheet particularly suitable for use in hospitals and the like.

Due to the lack of tension at the corners and across the top of the sheet of this invention, this sheet will not rip or tear during use so that the full life of the sheet material may be enjoyed. The adjustability of this sheet provides an actual reduction in the amount of material and number of sheet sizes required to fit the different size mattresses presently on the market. For example, a normal flat queen size sheet, when constructed in accordance with teachings of this invention, will fit a water bed mattress, an eastern king size mattress, and the western king size mattress. A normal flat double bed size sheet, when constructed in accordance with the teachings of the invention, will fit a queen size mattress, a double bed size mattress and a sofa or hide-a-bed mattress. A flat twin size sheet, when constructed in accordance with the teachings of this invention, will fit all twin bed size mattresses from 36 to 39 inches in width. Such a reduction in the number of sheets and the size of the sheets required to fit the mattresses on the market will result in a great savings in both material and fabrication costs. In addition, this invention may be employed on blankets, bedspreads, bed pads, and the like.

SUMMARY OF THE INVENTION

A fitted sheet of material adapted to cover a cushion has an upper sleeping panel and at least two side panels adapted to cover portions of the upper surface and portions of adjacent side surfaces of the cushion, respectively, when the sheet of material is fitted over the cushion. The sheet of material has a cut out portion which allows movement of a lower portion of the cushion through the cut out portion. Securing means adapted to removably connect the upper and side panels together around the cushion lower portion pass under the cushion lower portion when the sheet of material is fitted on the cushion to maintain the side panels in substantially fixed relationship to each other, whereby the sheet of material follows the natural contour of the cushion and is maintained in position on the cushion.

In one embodiment of the invention, the sheet and cushion are substantially rectangular and the sheet has a top sleeping panel and four depending side panels which are adapted to cover the top and side cushion surfaces, respectively, when the sheet is in position. A three sided, substantially rectangular aperture formed in at least one sheet corner provides a partially open sheet corner through which the lower portion of at least one cushion corner protrudes. A stitched dart at the sheet corner extends from the aperture towards the sheet top panel to form a partially open sheet corner which overlies the top of the cushion corner. An elongated flap attached to the lower edge of a first sheet side panel adjacent the sheet open corner extends towards an adjacent second side panel when the flap is folded under the cushion. The free end of the flap is adapted to overlie a portion of the adjacent second side panel and attachment means mounted on opposed faces of the overlying portions of the flap and the second side panel are adapted to removably secure the flap in a plurality of positions to the second side panel.

BRIEF DESCRIPTION OF THE DRAWINGS

A better understanding of the invention may be had from consideration of the following detailed description when taken in conjunction with the accompanying drawings, wherein.

DETAILED DESCRIPTION

This invention is characterized by a sheet having a top sleeping panel and various side panels which depend downwardly over the sides of a mattress. The side panels provide attachment for various flaps or straps which pass underneath the mattress corner to hold the sheet down on the mattress and which hold each sheet corner on the respective mattress corner. The primary force retaining the sheet in position is applied between the sheet side panels and flaps and the sides and bottom of the mattress. In this manner, the sheet is maintained in position without creating undue stresses at the sheet corners or across the top sleeping panel of the sheet.

Figure 1:
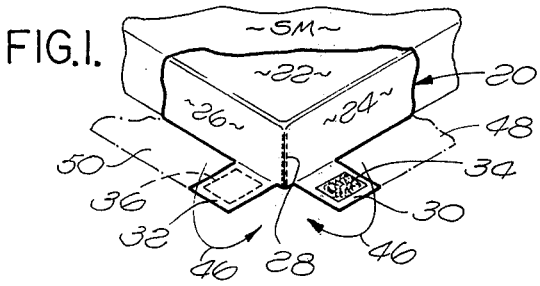
FIG. 1 is a fragmentary perspective view of a corner of a first embodiment of this invention with the flaps of the sheet extended.
Figure 2:
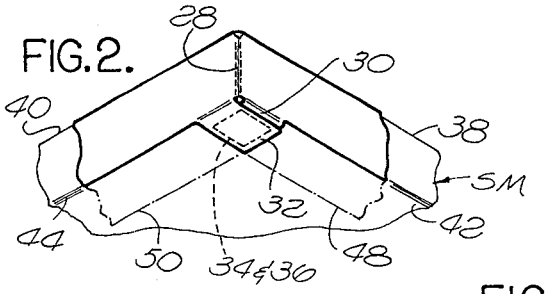
FIG. 2 is a fragmentary perspective view of the underside of the first embodiment of the invention shown in FIG. 1 with the flaps folded in operative position.

In the first embodiment of the invention shown in FIGS. 1 and 2, the sheet 20 is fitted over a boxed spring mattress SM so that the top sleeping panel 22 lies on the top sleeping surface of the mattress while the two side panels 24 and 26 depend from the top panel to cover the side surfaces of the mattress. The adjacent ends of the sheet side panels 24 and 26 are stitched together to form a mitered corner 28 which overlies the mattress corner. Flaps 30 and 32 are attached to or formed integrally with the lower edges of side panels 24 and 26 respectively adjacent the mitered corner 28. As shown in FIG. 1, flap 30 has on its upper surface an attachment means 34 while flap 32 has on its lower surface a mating attacment means 36. Such attachment means may be adhesive tape, male and female snaps, an eye and hook combination, or the like. However, in the preferred embodiment of this invention, the attacment means 34 and 36 are adhered strips or tapes, such as the Velcro-type tape.

In order to secure the sheet to the mattress, the sheet is folded over the top mattress edges 38 and 40 and the bottom mattress edges 42 and 44. Flap 30 is folded under the mattress SM and flap 32 then folded over flap 30 as indicated by the arrows 46. The adherend strips 34 and 36, upon contacting each other, resist separation and prevent the flaps 30 and 32 from being displaced with respect to each other by sliding movement across their adjacent surfaces. When the sheet is subjected to tension across its top panel, the primary force resisting removal of the sheet is applied between the sheet side panels and the sides of the mattress, the flaps and the bottom of the mattress, and the edges of the sheet overlying the edges of the mattress.

In an alternative embodiment of the invention shown in FIGS. 1 and 2, the flaps 30 and 32 may be part of bottom sheet panels 48 and 50 respectively, shown in phantom, if the material for such bottom panels is available. In the preferred embodiment of this invention, the panels 48 and 50 are an integral part of the entire sheet so that the adherend strips 34 and 36 are sewn on the ends of the bottom panels 48 and 50 respectively adjacent the mitered corner 28.

The sheets of this invention are adjustable for use with various sizes of mattresses. For example, where the mattress shown in FIGS. 1 and 2 is smaller in either height, length or width, the sheet may be adjusted by folding a portion of the side panels 24 and 26, as well as the flaps 30 and 32, under the mattress until a snug fit is obtained around the mattress corner. The degree of adjustability will depend primarily on the size and positioning of the adherend strips 34 and 36 since a portion of these strips must overlie each other when a snug fit is obtained in order to maintain the sheet in position. Thus, the dimensions and placement of such strips may be changed depending upon the various uses for which a particular sheet is designed.

Figure 5:
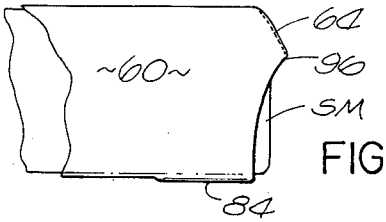
FIG. 5 is a cross-sectional elevational view taken along the line 5—5 of FIG. 4.
Figure 3:
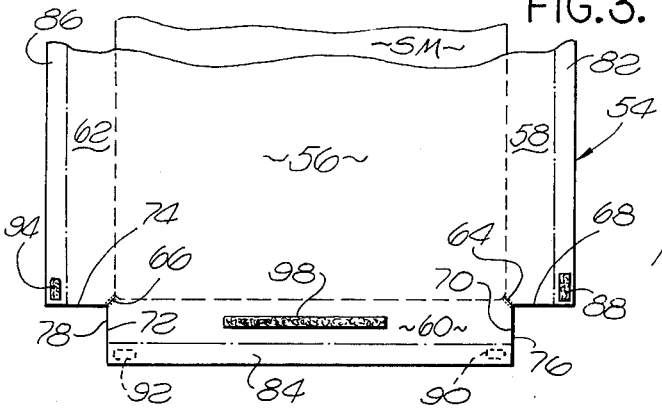
FIG. 3 is a fragmentary top plan view of a second preferred embodiment of this invention.
Figure 4:
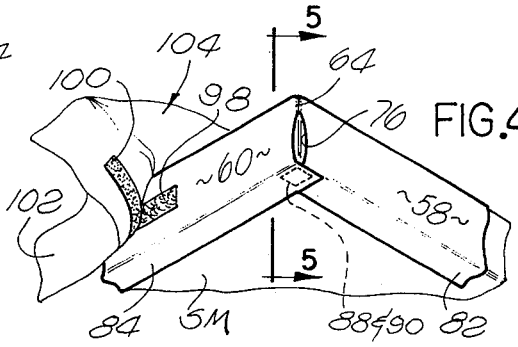
FIG. 4 is a fragmentary perspective view of the underside of the second embodiment of the invention shown in FIG. 3 with the flaps folded in operative position and showing partial installation of a top sheet.

In the second embodiment of the invention shown in FIGS. 3–5, the sheet 54 is positioned on a boxed spring mattress SM so that sheet top sleeping panel 56 rests on the top surface of the spring mattress SM while the sheet side panels 58, 60 and 62 depend downwardly over the side surfaces of the mattress as shown in FIG. 4. End portions of the side panels are cut out at each corner to form substantially perpendicular side panel edges 68, 70, 72 and 74. Adjacent pairs of these edges define apertures 76 and 78. These apertures are substantially in the form of an equilateral triangle having a corner at the intersections of the respective pairs of perpendicular side panel edges.

A portion of the sheet is stitched to form darts 64 and 66 extending inwardly towards the top panel from the apertures 76 and 78 respectively at the intersection of the side panel edges. The darts sewn in the sheets of this invention are normally formed by folding and sewing together the longitudinal edges of an elongated, substantially elliptical section of the sheet. Such an ellipse has its major axis extending into the sheet at an angle which substantially bisects the angle between the perpendicular edges of the adjacent side panels. The darts so formed may vary in length depending upon the depth of the mattress for which the sheet is designed and the appearance desired. For example, if no dart is desired, the sheet may be positioned so that the perpendicular side panel edges intersect directly above the mattress corner. If a large flap of darted material is desired to partially or entirely conceal the mattress corner, the dart may be any length up to the height of the mattress and the top corner of the mattress may be positioned anywhere beneath the dart. In the embodiment of the invention shown in FIGS. 3–5, the dart is about four inches long and the mattress corner is positioned under the inward terminus of the dart so that a flap of material 96 partially conceals the upper portion of the mattress corner.

Bottom panels 82, 84 and 86, formed integrally with side panels 58, 60 and 62 respectively, are folded under the mattress SM so that the adherend strips 88, 90, 92 and 94 will secure the adjacent ends of the bottom flaps together. As is shown in FIG. 3, the adherend strips 88 and 94 are applied to the top surfaces of the bottom panels adjacent the ends of bottom panels 82 and 86 respectively while the adherend strips 90 and 92 are applied to the bottom surface of the bottom panels adjacent opposite ends of the bottom panel 84.

As is shown in FIGS. 4 and 5, the sheet side panels, such as 58 and 60, depend downwardly to cover the sides of the mattress when the sheet is installed. The bottom panels 82 and 84 are then folded under the mattress so that the adherend strips 88 and 90 contact and adhere to each other to prevent the bottom flaps from being separated at their ends due to sliding movement of the overlying portions of the bottom panels. As has been previously explained, the primary force maintaining the sheet on the corner of the mattress is applied between the sheet side panels and the sides of the mattress, the sheet bottom panels and the bottom of the mattress, and the top and bottom edges of the mattress and the sheet material covering those edges.

Because the dart 64 is not a mitered corner, a loose flap of material 96 is formed, as is shown in FIG. 5, in this embodiment of the invention which covers the top portion of the mattress corner. The lower portion of the mattress corner, however, is free to protrude through the aperture 76. The aperture 76 changes from triangular to substantially oval in appearance when the sheet is installed, as shown in FIG. 4.

Figure 8:
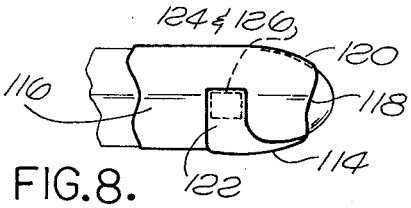
FIG. 8 is a cross-sectional elevational view taken along the line 8—8 of FIG. 7.
Figure 6:
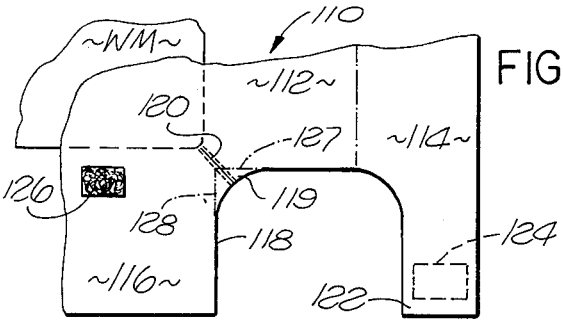
FIG. 6 is a fragmentary top plan view of a third embodiment of this invention.
Figure 7:
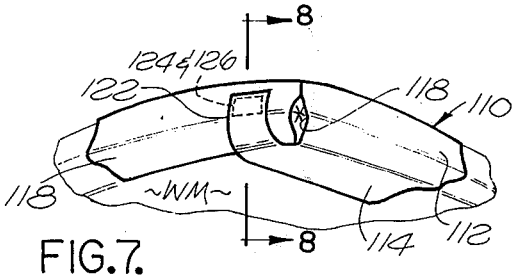
FIG. 7 is a fragmentary perspective view of the third embodiment of the invention shown in FIG. 6 with the flap folded in operative position.

The embodiment of the invention shown in FIGS. 3–5 is particularly useful with bed spring mattresses, while the embodiment shown in FIGS. 6–8 is particularly useful with water bed mattresses, in that the lower portion of each corner of the bed mattress is allowed to protrude through the aperture 76 below the stitched dart 64. This prevents the application of undue stress between the mattress corner and the sheet corner. In addition, the upper portion of a bed mattress corner fills out the flap 96, the dimensions of which may be changed by varying the dimensions of the dart so that the flap lies smoothly on the top of the mattress corner. In this manner, the stress of movement within the bed mattress is applied against the corners of the mattress rather than against the corners of the sheet, thus allowing expansion and contraction of the mattress corners within the apertures and preventing the sheet corners from tearing. This also avoids the tendency for the corners to pull up and over the mattress corners and in fact aids in maintaining the sheet corners in position on the mattress corners since a larger amount of mattress will protrude through the aperture as more pressure is applid to the center of the mattress.

As is shown in FIGS. 3 and 4, an adherend strip 98 may also be applied to a side panel 60 of the sheet to contact an overlying adherend strip 100 mounted on the inside of side panel 102 of top sheet 104. In order to increase the versatility of the bottom sheet so that it may be turned in any direction to equalize wear, a similar adherend strip may be applied to all four bottom sheet side panels so that the top sheet may then be secured in any of four directions across the bottom sheet.

In the third embodiment of the invention shown in FIGS. 6–8, the sheet 110 applied to water bed mattress WM has a first slide panel 112 and an integrally formed bottom flap or panel 114. A second side panel 116 is formed without any bottom panel. The flap 114 is preferably formed by cutting a substantially rectangular section out of the corner of the sheet to form aperture 118. The width of the side panels is equal to the height of the mattress, which in the case of water beds is about ten inches. The dart 120, formed as previously described, is about six inches in length. The inward terminus of the dart overlies the beginning slope of the mattress corner so that the flap of material surrounding the dart lies substantially flat against the upper portion of the mattress corner, as is shown in FIG. 8.

A substantially triangular portion of material 119, shown in FIG. 6, bridging the edges of the side panels 112 and 116 is provided to increase the depth of the flap of material covering the top of the mattress corner. In an alternative embodiment, this flap may be removed in cutting the aperture 118 by merely extending the cut along the lines 127 and 128 to form a square corner.

In order to install the sheet, the side panels 112 and 116 are allowed to depend down to cover the sides of the water bed mattress and the dart is positioned over the top of the mattress cover as described above. The flap 114 is then folded or tucked under the mattress so that the free flap end 122 protrudes from underneath the mattress adjacent side panel 116 sufficiently for the adherend strip 124 sewn on the flap to contact and adhere to the adherend strip 126 sewn on the side panel 116 when the flap is raised to overlie the side panel. The position of the adherend strip 126 on the side panel will depend on the width of the flap 114. Similarly, the size of the adherend strips 124 and 126 will depend on the amount of adjustability desired. The aperture 118 is formed into a substantially oval shape between adjacent vertical edges of the side panels, as is shown in FIG. 7, when the flap 114 is in operative position to allow the lower portion of the water bed mattress corner to protrude therethrough as previously described and as shown in FIG. 8.

Figure 9:
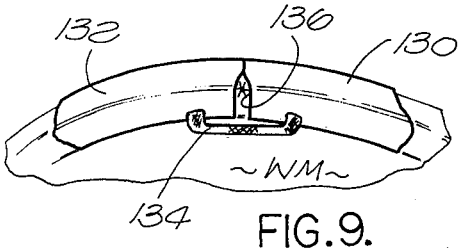
FIG. 9 is a fragmentary perspective view showing a fourth embodiment of this invention in operative position.

The fourth embodiment of the invention shown in FIG. 9 is similar to the embodiment previously described in connection with FIGS. 6–8 except that instead of a bottom panel, the side panels 130 and 132 are secured together by a strap 134, composed of a cotton or the like. Strap 134 is secured adjacent the bottom edges of the side panels 130 and 132 near the aperture 136 to pass under the water bed mattress WM and allow the lower portion of the mattress corner to protrude through the aperture.

Figure 10:
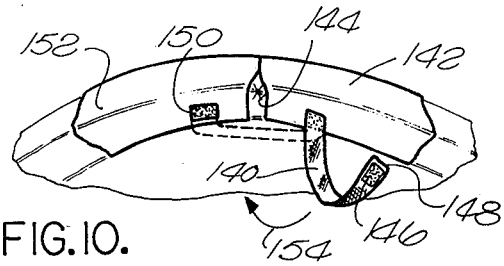
FIG. 10 is a fragmentary perspective view of a fifth embodiment of this invention; and, FIG. 11 is a fragmentary top plan view of a sixth embodiment of this invention.

The fifth embodiment of the invention shown in FIG. 10 is similar to the embodiment described in connection with FIG. 9 except that the strap 140 is permanently secured to only one side panel 142 near the aperture 144. Adherend strip 146 mounted on the free end 148 of the strap overlies and adheres to adherend strip 50 sewn on side panel 152 when the strap is passed under the corner of the mattress in the direction of arrow 154 and is raised to overlie side panel 152. The aperture 144 allows the lower portion of the mattress corner to protrude through the aperture to substantially prevent pressure between the sheet corner and the mattress corner.

In order to insure that the material adjacent the stitched darts described in previous embodiments will not ride up on the mattress corner, the securing means need to be attached adjacent the very edges of the flaps and the flaps need to be pulled tightly together so that the stress travels along the cut edge of the flaps directly to about the point where the dart terminates at the aperture.

Figure 11:
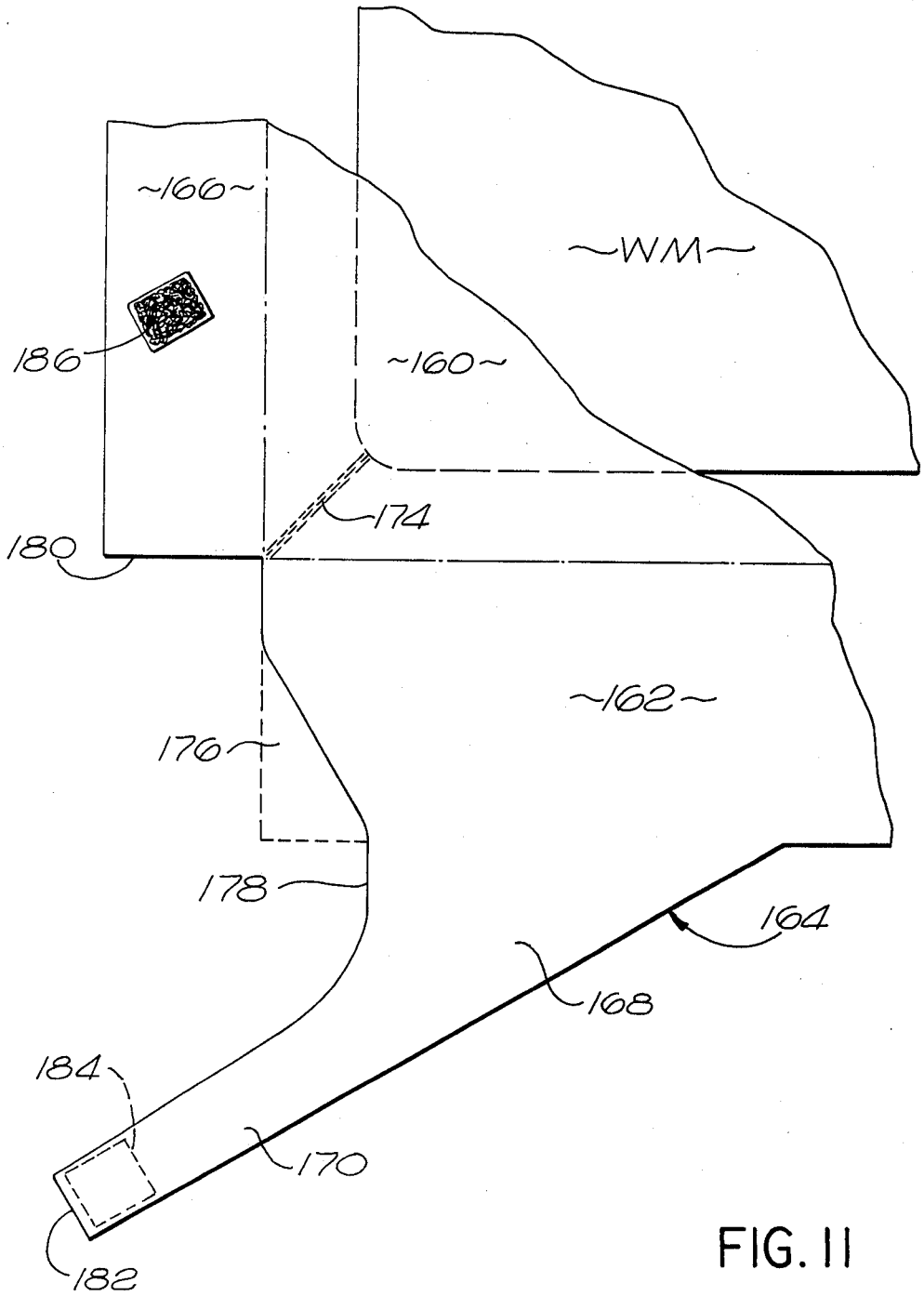

The sixth embodiment of the invention, shown in FIG. 11, is designed to automatically solve this problem. The sheet 160 is applied to water bed mattress WM and has a first side panel 162 and a bottom flap or panel 164 secured to the panel 162. A second side panel 166 is formed without any bottom panel. The flap 164 is preferably formed integrally with the first panel 162. However, the flap 164 may be formed separately and sewn to the first panel. The width of the first side panel 162 is equal to the height of the mattress, which in the case of water beds is about ten inches. The second side panel may be of various width, and in this embodiment is about five inches wide. The dart 174, formed as previously described, is about 6 inches in length. The inward terminus of the dart overlies the beginning slope of the mattress corner so that the flap of material surrounding the dart lies substantially flat against the upper portion of the mattress corner.

This design is a modification of the embodiment shown in FIG. 6, with the first side panel 162 having a generally triangular portion 176 cut out of the end of the first panel and the flap or strap 164 formed at a slight angle to the longitudinal axis of the first panel 162. In this embodiment of the invention, the shank 170 is formed at an angle of about 35 degrees to the longitudinal axis of the first panel 162. The head portion 168 of the strap 164 along the edge 178 may be any desired width depending upon the length of sheet desired. In this embodiment, the edge 178 is 2 inches long. In an alternative embodiment, where the sheet is integrally formed, the sheet will be cut to an appropriate length and the strap shank 170 will be formed integrally with the side panel 162 so that the head portion 168 of the strap 164 will be entirely eliminated.

The side panel 162 is cut out at portion 176 (shown in phantom) so that the strap 168 can be secured to or formed integrally with the beginning of the side panel 162 while at the same time allowing the strap to pass underneath the mattress far enough back from the mattress corner to securely hold the sheet onto the corner. This will prevent the strap from slipping out from underneath the mattress under tension. The panel 162 is cut out at portion 176 to a point where the strap contacts the panel so that the stress lines travel along the edge 178 of the strap and the edge of the panel 162 to the point where the dart 174 meets the sheet corner aperture 180.

In order to install the sheet, the side panels 162 and 166 are allowed to depend down to cover the sides of the water bed mattress WM and the dart 174 is positioned over the top of the mattress as described above. The flap or strap 164 is then folded or tucked under the mattress so that the free flap end 182 protrudes from underneath the mattress adjacent the second side panel 166 sufficiently for the adherend strip 184, sewn on the flap, to contact and adhere to the adhered strip 186, sewn on the side panel 166, when the flap is raised to overlie the second side panel. The position of the adherend strip 186 on the side panel will depend on the length and angle of the strap 68. Similarly, the size of the adherend strips 184 and 186 will depend on the amount of adjustability desired.

A sheet is thus provided by this invention which is suitable for use not only with a normal coil spring-type boxed mattress but also with water bed mattresses and various other cushions. In addition, sheets, blankets, bed pads, and the like constructed in accordance with this invention are adjustable to fit various size cushions and mattresses. Such sheets do not wear as quickly as contoured sheets, have fitted ends, and when employed with water bed mattresses provide a positive attachment to the mattress corners which will not loosen during use and which will not tear at the sheet corners.

It will be apparent that various modifications may be made in the embodiments of the invention shown and described herein, all within the scope of this invention. For example, the dimensions of the corners, darts, apertures, side panels, and flaps may be varied. In addition, the attachment means may be of various sizes, positioned in various locations, and composed of various materials, all within the scope of this invention.

What is claimed is:

1. A fitted sheet of material adapted to cover a cushion, said sheet comprising:

a sheet of material having at least an upper panel and at least two side panels, said upper panel and side panels being adapted to cover portions of the upper surface and portions of adjacent side surfaces of said cushion, respectively, when said sheet of material is fitted over said cushion;

said sheet of material having a cut out portion which allows movement of a lower portion of the cushion through the cut out portion; and means mounted on the sheet of material adapted to removably connect said upper and side panels around said cushion lower portion, at least a portion of said securing means being adapted to pass under said cushion lower portion when said sheet of material is fitted on said cushion and to connect said side panels together to maintain said side panels in substantially fixed relationship to each other so that said sheet of material follows the natural contour of said cushion, whereby said sheet of material is maintained in position on said cushion.

2. A fitted sheet of fabric adapted to cover a cushion, said sheet comprising:

a sheet of fabric having at least one area adapted to fit over at least the upper cushion surface adjacent a corner of said cushion, an upper sleeping panel, and at least two side panels, said upper and side panels being adapated to cover portions of the upper surface and portions of two side surfaces of said cushion, respectively, when said sheet is fitted over said cushion;

said sheet of fabric corner having a cut out portion which allows movement of the lower portion of a cushion corner through the cut out portion; and, means mounted on said sheet of fabric adjacent said cut out portion adapted to removably connect said adjacent side panels, at least a portion of said connecting means being adapted to pass under said cushion corner when said sheet of fabric is fitted on said cushion and to secure onto at least one of said side panels to maintain said side panels in substantially fixed relationship to each other so that said sheet follows the natural contour of said cushion, whereby said sheet of fabric is maintained in position adjacent said cushion corner.

3. A fitted sheet as defined in claim 2, wherein said sheet and cushion are substantially rectangular.

4. A fitted sheet as defined in claim 3, further comprising:

a stitched dart beginning at the sheet cut out portion and extending inwardly towards the sheet upper panel, said stitched dart providing a partial pocket which lies smoothly over the top of the cushion corner and which allows the lower portion of the cushion corner unrestricted movement through said cut out portion.

5. A fitted sheet as defined in claim 4, wherein said connecting means comprises:

a flap attached adjacent the lower edge of each of at least one of said sheet side panels adjacent said cut out portions, said flap being adapted to fold under said cushion; and, attachment means adapted to connect the flap to the adjacent side panel in a plurality of positions.

6. A fitted sheet as defined in claim 5, wherein:

said flap comprises an elongated strip of material attached to the lower edge of a first one of said side panels, said flap extending parallel to the longitudinal axis of said first side panel and towards the second side panel when said flap is folded under said cushion, one end of said flap being adapted to overlie said second side panel after said flap has been folded under said cushion; and said attachment means comprises means mounted on opposed faces of the overlying portions of said flap and said second side panel adapted to connect said flap to said second side panel in a plurality of positions when said flap and second side panel are brought into overlying relationship.

7. A fitted sheet as defined in claim 5, wherein:

said flap comprises an elongated strip of material attached to the lower edge of a first one of said side panels, said flap extending outwardly at an angle to the longitudinal axis of said first side panel and towards the second side panel when said flap is folded under said cushion, one end of said flap being adapted to overlie said second side panel after said flap has been folded under said cushion; and said attachment means comprises means mounted on opposed faces of the overlying portions of said flap and said second side panel adapted to secure said flap to said second side panel in a plurality of positions when said flap and second side panel are brought into overlying relationship.

8. A fitted, adjustable bed sheet adapted to be positioned on a bed mattress, comprising:

a substantially rectangular fabric having a top sleeping panel, a plurality of depending side panels, and a substantially rectangular, three sided aperture formed in at least one sheet corner so that the adjacent ends of the side panels are spaced apart to form a partially open corner when the sheet top panel and side panels are positioned over the bed mattress top and side surfaces respectively, said corner having a stitched dart about two to six inches in length beginning at said aperture and extending inwardly towards the sheet top panel, whereby at least one partially open, stitched sheet corner is formed between adjacent sheet side panels to allow the lower portion of at least one bed mattress corner to protrude through said at least one aperture for unrestricted movement while the stitched portion of each sheet corner lies smoothly over the top of the mattress corner when the sheet top sleeping panel and side panels are positioned to cover the upper surface and side surfaces of the mattress respectively;

an elongated flap attached to the lower edge of a first one of said side panels adjacent the stitched corner, said flap extending from said first side panel towards the adjacent second side panel when said flap is folded under said mattress, the free end of said flap being adapted to overlie a portion of said adjacent second side panel after said flap has been folded under the mattress corner; and attachment means mounted on opposed faces of the overlying portions of said flap and second side panel, said attachment means being adapted to removably secure said flap in a plurality of positions to said second side panel when said flap is brought into overlying relationship with the second side panel, whereby said at least one sheet corner is adapted to be maintained in position on the mattress corner by said sheet corner and said flap bearing against the mattress adjacent the mattress corner.

9. A fitted, adjustable sheet as defined in claim 8, further comprising:

second attachment means secured to each sheet side panel, said second attachment means being adapted to removably and adjustably secure a top sheet bearing corresponding attachment means to a side panel of said fitted sheet.

10. A fitted, adjustable sheet as defined in claim 8 wherein said flap extends substantially parallel to the longitudinal axis of said first side panel.

11. A fitted, adjustable sheet as defined in claim 8 wherein said flap extends outwardly at an angle to the longitudinal axis of said first side panel.

* * * * *